US008522667B2

(12) United States Patent
Clemens

(10) Patent No.: US 8,522,667 B2
(45) Date of Patent: Sep. 3, 2013

(54) PUMP LINER RETENTION DEVICE

(75) Inventor: Don Clemens, Spring, TX (US)

(73) Assignee: TSC Offshore Group Limited, Houston, TX (US)

( * ) Notice: Subject to any disclaimer, the term of this patent is extended or adjusted under 35 U.S.C. 154(b) by 797 days.

(21) Appl. No.: 12/770,407

(22) Filed: Apr. 29, 2010

(65) Prior Publication Data

US 2010/0275773 A1 Nov. 4, 2010

Related U.S. Application Data

(60) Provisional application No. 61/174,281, filed on Apr. 30, 2009.

(51) Int. Cl.
*F16J 10/02* (2006.01)
*F01B 29/00* (2006.01)

(52) U.S. Cl.
USPC ..... 92/171.1; 92/128; 92/140

(58) Field of Classification Search
USPC ..... 92/128, 140, 171.1; 29/888.061
See application file for complete search history.

(56) References Cited

U.S. PATENT DOCUMENTS

| | | | |
|---|---|---|---|
| 6,209,445 | B1 | 4/2001 | Roberts, Jr. et al. |
| RE37,483 | E | 12/2001 | Kennedy et al. |
| 6,588,318 | B2 | 7/2003 | Aday et al. |
| 7,234,388 | B2 | 6/2007 | Orr et al. |
| 7,287,460 | B2 | 10/2007 | Riley et al. |
| 2008/0279683 | A1 | 11/2008 | Kennedy |

FOREIGN PATENT DOCUMENTS

| | | | |
|---|---|---|---|
| GB | 2285489 | A | 7/1995 |
| JP | 10-253177 | A | 9/1998 |
| JP | 11-093417 | A | 4/1999 |
| JP | 2006-220144 | A | 8/2006 |
| KR | 2006-0052494 | A | 5/2006 |

OTHER PUBLICATIONS

International Search Report and Written Opinion Mailed Dec. 23, 2010, in International Application No. PCT/US2010/032705.

*Primary Examiner* — Michael Leslie

(74) *Attorney, Agent, or Firm* — Patterson & Sheridan, L.L.P.

(57) ABSTRACT

A method and apparatus for maintaining a seal between a cylinder and a fluid manifold for a reciprocating force delivery device is disclosed. A cylinder retention assembly comprises a rotatable member with a variable topography surface. The rotatable member is disposed against a stop extending outwardly from the cylinder, and is fastened to the fluid manifold by a locking ring. When rotated, the rotatable member produces an axial force on the locking ring and the cylinder, urging the cylinder against the fluid manifold. The cylinder retention assembly may be used in reciprocating pumps and compressors.

23 Claims, 13 Drawing Sheets

PUMP LINER RETENTION DEVICE

CROSS-REFERENCE TO RELATED APPLICATIONS

This application claims benefit of U.S. Provisional Application Ser. No. 61/174,281, filed Apr. 30, 2009, which is incorporated herein by reference.

FIELD

Embodiments of the invention relate to accessories for reciprocating force delivery devices. More specifically, embodiments disclosed herein relate to devices and methods for maintaining a seal between a cylinder and a fluid manifold in a reciprocating piston and cylinder device.

BACKGROUND

Production of oil and gas is a trillion dollar industry. To get oil and gas out of the earth, large costly equipment is used under extreme conditions. For example, reciprocating pumps that generate very high pressures are used for pumping liquids into and out of holes that are miles deep. Such pumps are either pumping against the pressure of fluids trapped beneath millions of tons of rock or taking suction of those fluids, so they must be functional for long periods of time under extreme stress.

One example of a reciprocating pump that routinely develops pressures of several thousand pounds per square inch is a drilling fluid pump. Drilling fluid (also called "drilling mud") is a dense, viscous substance pumped into an active drilling hole to cool the drilling bit, lubricate the drill stem, support the walls of the wellbore, discourage premature entry of fluids into the wellbore, reveal the presence of oil or gas in a drilling formation, and carry cuttings to the surface where they can be removed. Higher viscosity drilling fluid is able to carry more and heavier cuttings, so additives are frequently used to increase viscosity. Pumping a high viscosity, high density fluid into a highly pressurized wellbore through miles of pipe requires very high pressure.

Reciprocating force delivery devices such as drilling fluid pumps operate by guiding a piston along a cylinder. One end of the cylinder is coupled to a fluid manifold which admits fluid when the piston is retracted. When the piston is advanced the fluid is forced from the manifold under pressure. The piston is generally driven by a rod or rod assembly coupled to a motor.

The cylinder forms a seal with the fluid manifold that must be maintained by urging the cylinder against the fluid manifold. A retention device is used to apply the sealing force to the cylinder. Prior art retention devices rely on rings that must be bolted to the fluid manifold by applying balanced tensile loads to the bolts to avoid unbalanced sealing force resulting in a weak seal. Other prior art retention devices rely on complex hardware with numerous parts to enable use of hydraulic force to balance the load on the seal. In many cases, sealing and seating of prior art devices is aided by hydraulic mechanisms that require hydraulic fluids, use of which may harm local ecosystems. It is also common to use potentially unsafe methods of impulse torquing (i.e. hitting with a sledgehammer) to complete seating and sealing. Moreover, while it is desirable to apply a balanced load to seal the cylinder to the fluid manifold, oil field equipment often must be operated far from available supplies of parts. Equipment having few parts that are easily assembled is generally favored.

Thus, there remains a need for a cylinder retention device for a reciprocating force delivery device that provides a load-balanced seal with minimal parts and easy assembly.

SUMMARY

Embodiments described herein provide a retention assembly for a reciprocating force delivery device having a cylinder liner abuting a fluid manifold, comprising a collar rotatably disposed around the cylinder liner, a locking ring disposed around the cylinder liner and distal to the fluid manifold, a compression ring between the locking ring and the collar, and a plurality of fasteners that fasten the locking ring to the fluid manifold.

Other embodiments provide a reciprocating force delivery device, comprising a motor, a reciprocating drive that couples the motor with a piston assembly comprising a piston movably disposed within a cylinder, a fluid manifold abutting an end of the cylinder, and a cylinder retention assembly attached to the fluid manifold and disposed around the cylinder, comprising a locking ring attached to the fluid manifold by fasteners, and a rotatable collar disposed between the locking ring and a shoulder of the cylinder such that rotation of the collar applies an axial force to the cylinder and the locking ring.

Other embodiments provide a method of maintaining a seal between a reciprocating force delivery device comprising a piston movably disposed within a cylinder, and a fluid manifold coupled to the cylinder, comprising providing a rotatable element located between a shoulder on an external surface of the cylinder and a locking ring fastened to the fluid manifold with fasteners forming a variable topography interface between the rotatable element and a compression ring disposed between the rotatable element and the locking ring, and rotating the rotatable element with respect to the compression ring to apply an axial force to the cylinder and the locking ring.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments described herein generally provide methods and apparatus for maintaining a seal between a cylinder and a fluid manifold in a reciprocating force delivery system such as a pump or compressor. Such a system generally comprises a motor, a reciprocating drive for converting the rotary motion of the motor into linear motion of a piston disposed within a cylinder, and a fluid manifold coupled to the cylinder and abutting one end of the cylinder. The opening through the cylinder generally mates with an opening in the fluid manifold.

The cylinder abuts the fluid manifold around the opening therein, and a seal is maintained between the cylinder and the manifold by a retention device which applies a compressive axial force to the cylinder. The retention device generally abuts a shoulder that extends from an external surface of the cylinder, applying the axial force to the shoulder of the cylinder.

Figure 1:
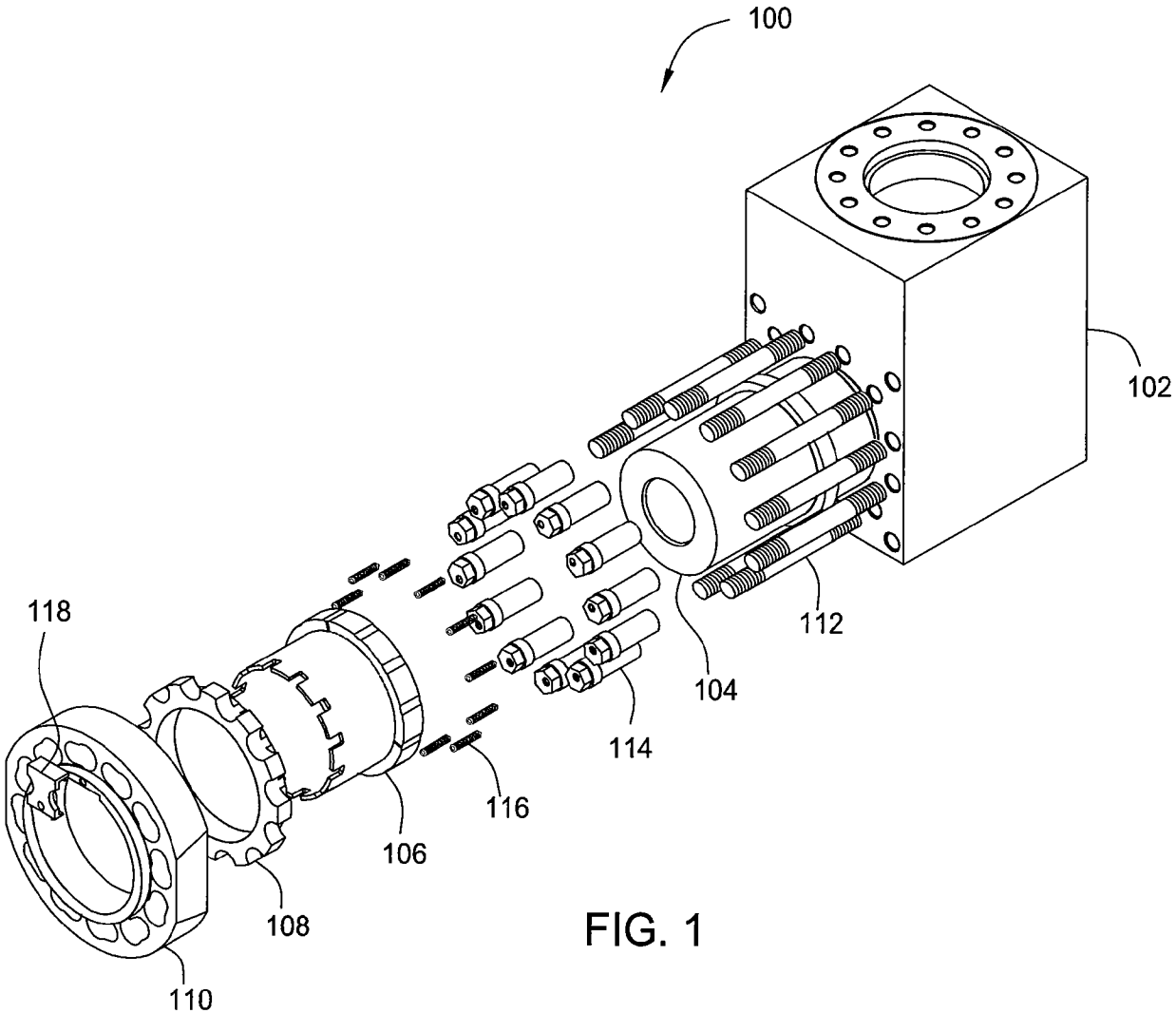
FIG. 1 is an exploded isometric view of a cylinder liner retention assembly according to one embodiment.

FIG. 1 is an exploded isometric view of a cylinder liner retention assembly 100 according to one embodiment. A fluid manifold 102 abuts a cylinder 104. A collar 106 fits over the cylinder 104 and abuts a shoulder on the cylinder 104, as further described below in connection with FIGS. 2-4C. A compression ring 108 fits over the collar 106, and a locking ring 110 fits over the collar 106. Fasteners 112 fasten the locking ring 110 to the fluid manifold 102 by positioning heads 114 through openings 120, rotating the locking ring 110 to engage the fasteners 112, and installing a clamp 118 to prevent any counter-rotation of the locking ring 110 after installation. The heads 114 of the fasteners 112 may be permanently attached to the fasteners 112 after installation by installing fasteners 116, such as threaded bolts or screws, through the heads 114 into the fasteners 112.

Figure 2:
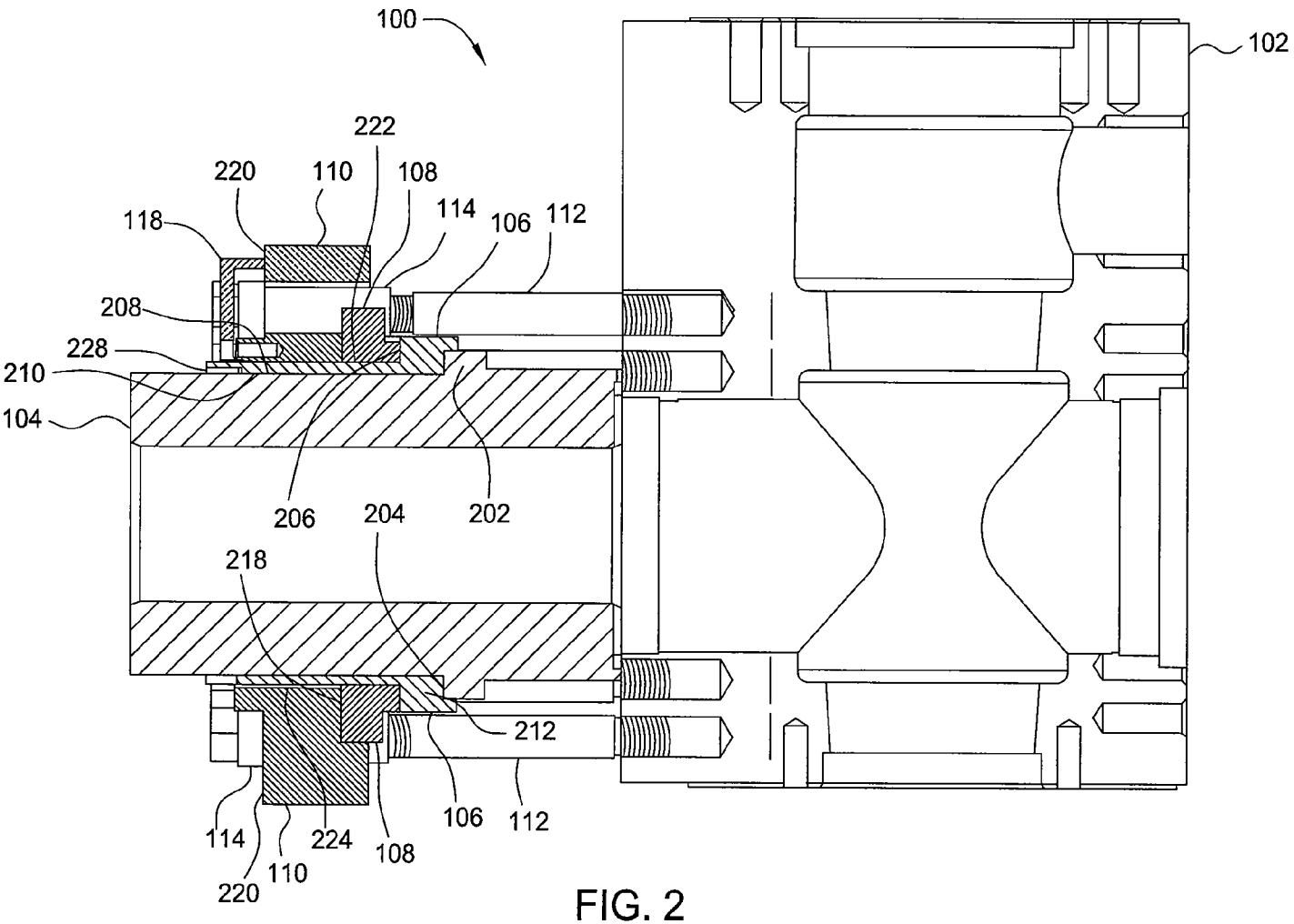
FIG. 2 is a cross-sectional view of the cylinder liner retention assembly of FIG. 1 in an assembled state.

FIG. 2 is a cross-sectional view of the cylinder liner retention assembly of FIG. 1 in an assembled state. The collar 106 has an inner surface 208 that slidably contacts an outer surface 210 of the cylinder 104. The collar 106 has an outwardly extending flange 212 with a shoulder 204 that seats on an outwardly extending stop 202 of the cylinder 104. The flange 212 also has a locking face 206 opposite the shoulder 204 that abuts a locking face 214 of the compression ring. A pressure face 216 of the compression ring opposite the locking face 214, abuts a pressure face 218 of the locking ring 110, and an outward face 220 of the locking ring 110 engages the heads 114 of the fasteners 112. A portion of the collar 106 is positioned between the cylinder 104 and the compression ring 108, so that the compression ring 108 fits over the collar 106, an inner surface 222 of the compression ring 108 slidably contacting an outer surface 224 of the collar 106. A portion of the collar 106 is also positioned between the cylinder 104 and the locking ring 110, so that the locking ring 110 fits over the collar 106, an inner surface 226 of the locking ring 110 slidably contacting the outer surface 224 of the collar 106. The collar 106 is accessible at a second end 228 of the collar 106 to facilitate rotating the collar 106, as described further below in connection with FIG. 5.

Figure 3A:
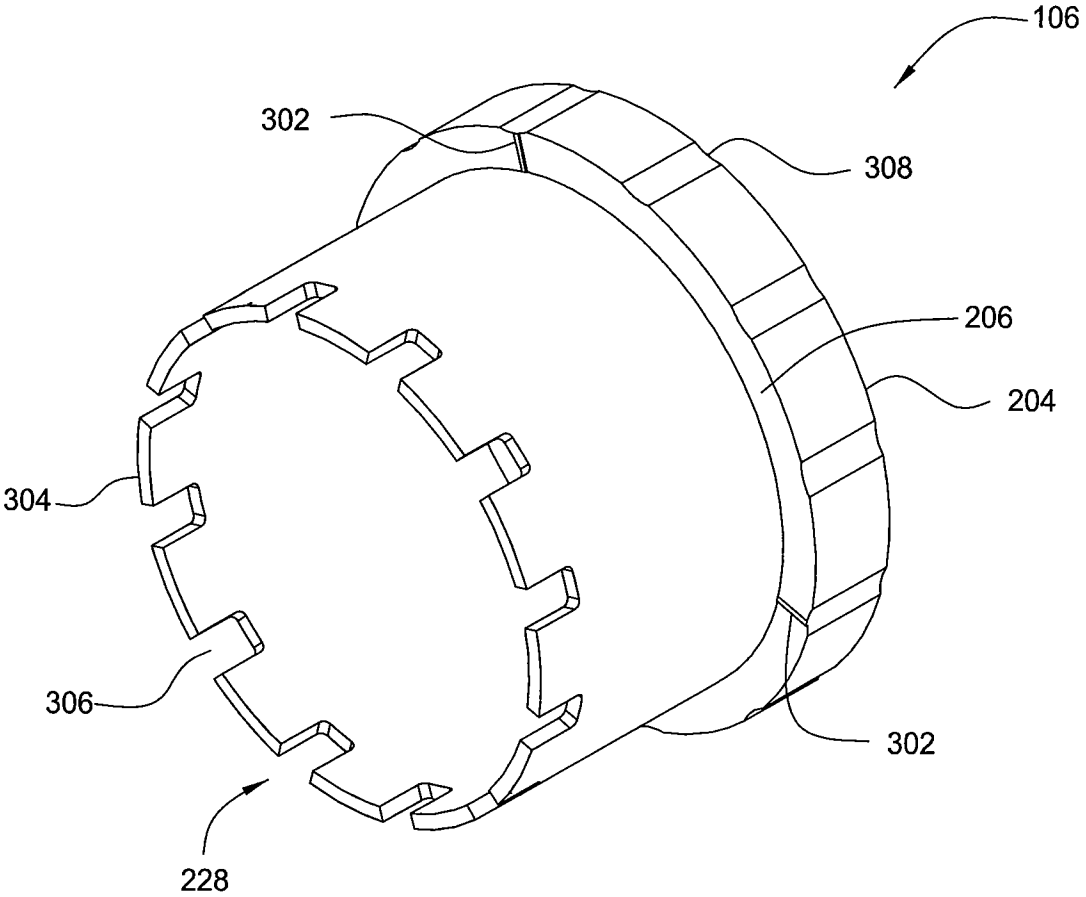
FIG. 3A is a perspective view of a collar of the cylinder liner retention assembly of FIG. 1.

FIG. 3A is a perspective view of the collar 106 of FIGS. 1 and 2. The locking face 206 of the collar 106 has one or more ridges 302 that form a variable topography surface abutting the locking face 214 of the compression ring 108. The distance between the shoulder 204 and the locking face 206 of the collar 106 define a thickness of the flange 212 that varies about an average value by less than about 2%, such as less than about 1%, for example about 0.6%. The second end 228 of the collar 106 has fingers 304 and grooves 306, which may have any convenient shape, to facilitate rotating the collar 106 when the retention assembly is in an assembled state. The flange 212 also has scalloped recesses 308 to accommodate the fasteners 112 installed around the collar 106.

Figure 3C:
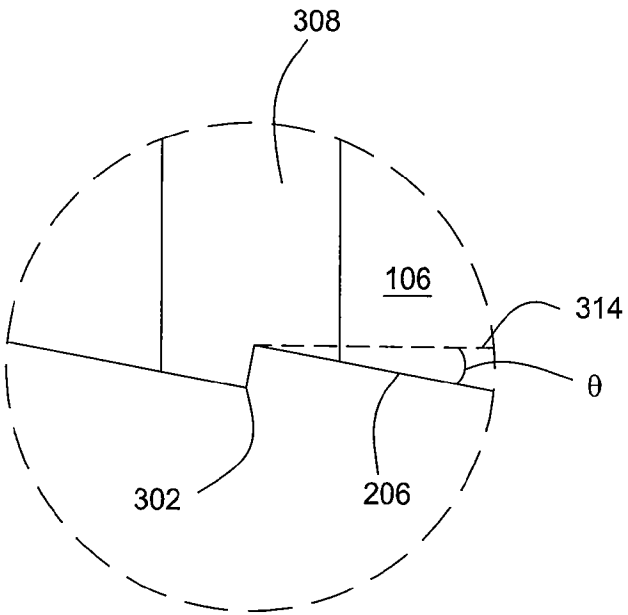
FIG. 3C is a detailed side view of a portion of the collar of FIG. 3A.
Figure 3B:
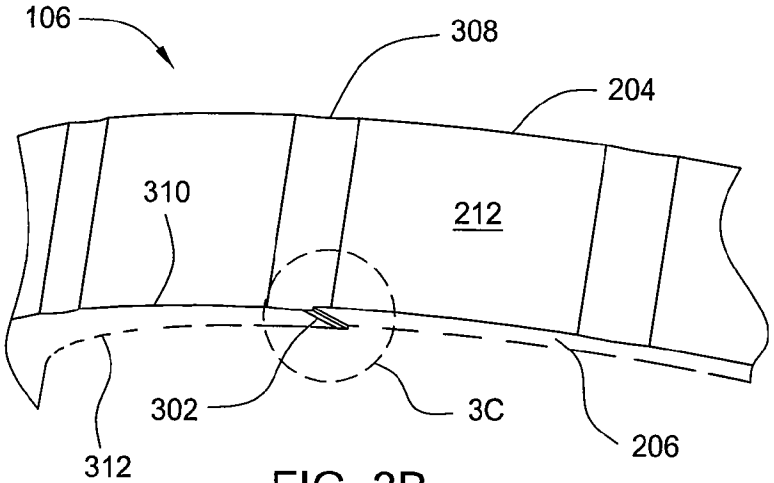
FIG. 3B is a detailed perspective view of a portion of the collar of FIG. 3A.

FIG. 3B is a detailed perspective view of a portion of the collar 106 of FIG. 3A. One of the ridges 302 is shown extending from a first edge 310 of the flange 212 to a second edge 312 of the flange 212. The ridge 302 visible in FIG. 3B illustrates the variable topography of the locking face 206 of the flange 212. The ridge 302 connects two portions of the locking face 206 having different elevation. The elevation difference between the two portions may be up to about 4% of the thickness of the flange 212 defined by the shoulder 204 and the locking face 206, such as up to about 2% of the thickness, for example about 1.2% of the thickness.

FIG. 3C is a detailed side view of a portion of the collar 106 of FIG. 3A. The locking face 206 of the flange 212 is visible, along with a ridge 302 and a recess 308. The locking face 206 forms an angle θ with a plane 314 defined by the shoulder 204 of the flange 212 (FIG. 3B). The locking face 206 is thus not parallel to the shoulder 204. The angle θ may be up to about 2° in some embodiments, such as less than about 2°, or less than about 1°, for example about 0.7°.

Figure 4A:
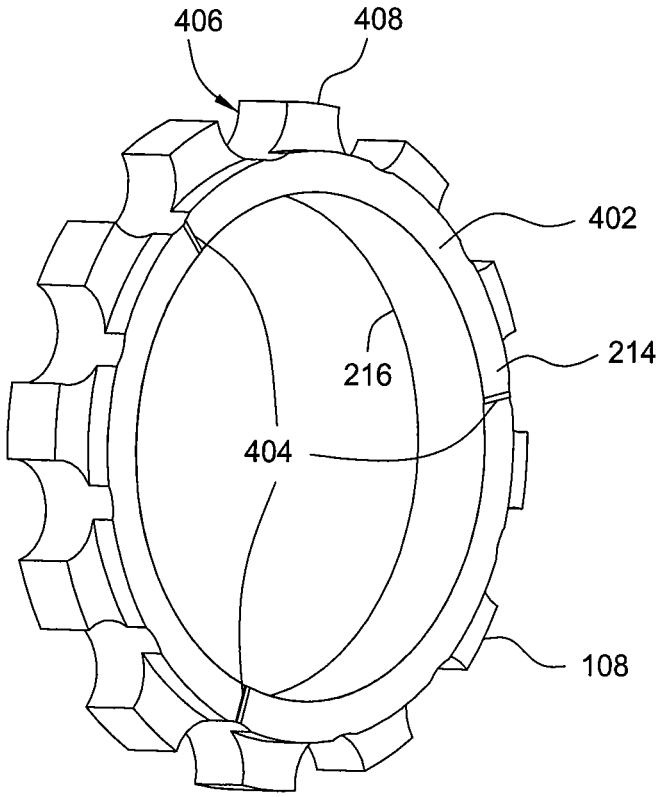
FIG. 4A is a perspective view of a compression ring of the cylinder liner retention assembly of FIG. 1.

FIG. 4A is a perspective view of the compression ring 108 of FIGS. 1 and 2. The locking face 214 of the compression ring is shown. The compression ring has scalloped recesses 406 that enable installation of the fasteners 112, and extensions 408 that prevent rotation of the compression ring 108 when the fasteners 112 are installed. Similar to the collar 106, the compression ring 108 has one or more ridges 404 to give the locking face 214 of the compression ring 108 a variable topography for abutting the locking face 206 of the collar 106. The locking face 214 and pressure face 216 of the compression ring 108 define a thickness of the compression ring 108 that varies about an average value by less than about 2%, such as by less than about 1%, for example about 0.6%.

Figure 4B:
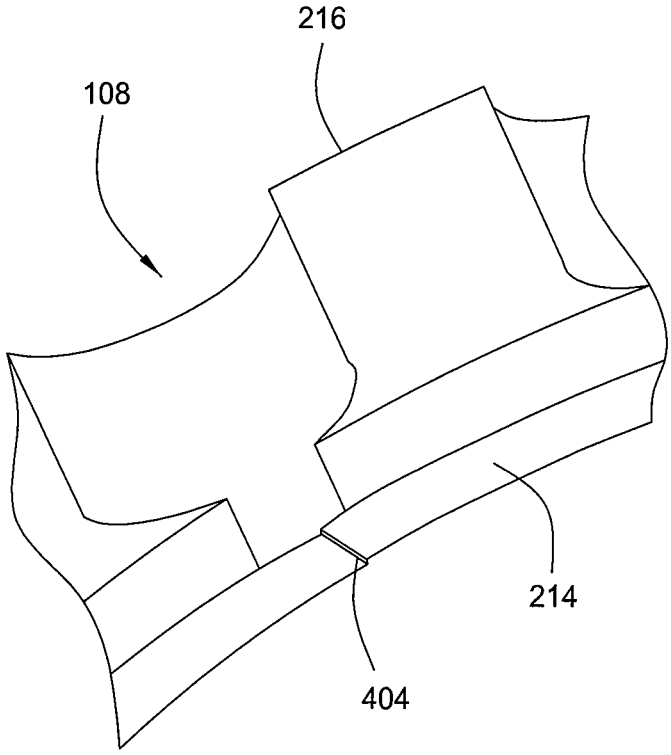
FIG. 4B is a detailed view of the compression ring of FIG. 4A.
Figure 4C:
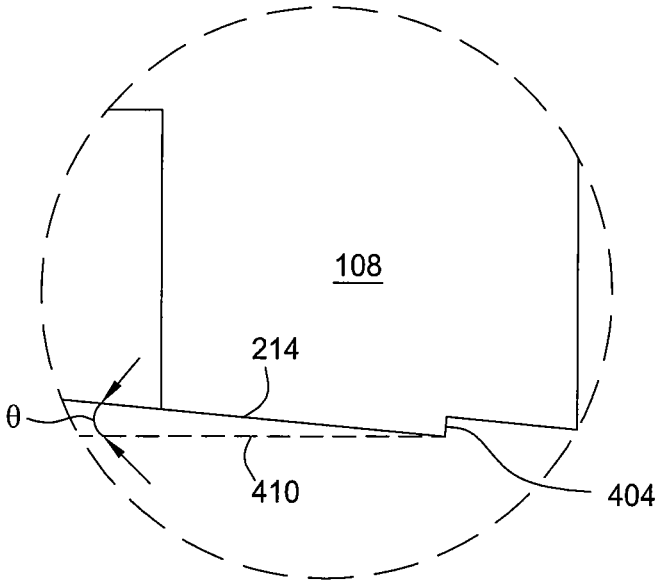
FIG. 4C is another detailed view of the compression ring of FIG. 4A.

FIG. 4B is a detail view of the compression ring 108 of FIG. 4A, showing the ridge 404 in a similar way to the view of FIG. 3B. FIG. 4C is a detailed view, similar to the view of FIG. 3C, of the compression ring 108. As with the locking face 206 of the collar 106, the ridge 404 connects portions of the locking face 214 of the compression ring 108 having different elevation. The difference in elevation may be up to about 4% of the thickness defined by the locking face 214 and pressure face 216 of the compression ring 108, such as up to about 2% of the thickness, for example about 1.2% of the thickness. The locking face 214 of the compression ring 108 forms an angle θ with a plane 410 defined by the pressure face 216 of the compression ring 108 (FIG. 4B). Thus, similar to the collar 106, the locking and pressure faces 214 and 216 of the compression ring 108 are not parallel. The angle θ may be up to about 2° in some embodiments, such as less than about 2°, or less than about 1°, for example about 0.7°.

Figure 4D:
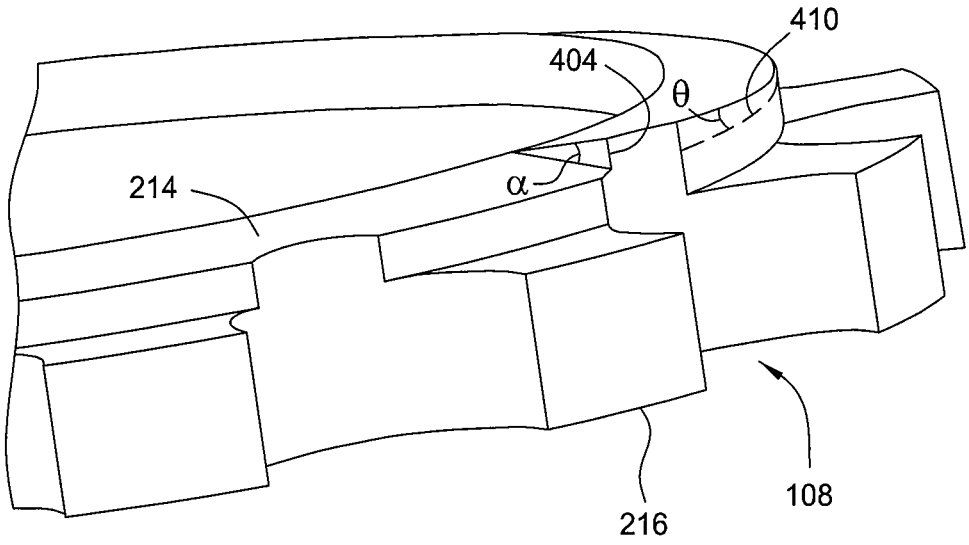
FIG. 4D is a detailed view of a compression ring according to another embodiment.

FIG. 4D is a detailed view of a compression ring 108 according to another embodiment. The compression ring 108 of FIG. 4D features the locking face 214 that forms an angle θ with respect to the pressure face 216, as for the embodiment of FIG. 4C. In addition, the locking face 214 of FIG. 4D forms an angle α with respect to the pressure face 216 in a direction orthogonal to the direction of the angle θ. The embodiment of FIG. 4D increases the contact surface between the locking face 214 and the locking face 206 of the collar 106 to spread the contact stress between the two articles over a larger surface. The angle α elevates one edge of the locking face 214 above the other, such that the two edges do not propagate together in the plane of the pressure face 216. In the embodiment of FIG. 4D, the inner edge of the locking face 214 is circular and progresses in a path parallel to the pressure face 216, while the outer edge of the locking face 214 progresses generally helically with respect to the pressure face 216. The angle α may have any value between about 0.1° anc about 25°, depending on the needs of individual embodiments. Generally, the angle α will be larger with higher pressure systems to increase the area over which the contact stress is distributed.

It should be noted that in some embodiments, the inner edge of the locking face 214 may progress in a helical pattern similar to the outer edge, but at a different angle θ' of inclination. In the embodiment of FIG. 4D, the angle θ' is zero. In some embodiments, it may be advantageous for the angle of inclination of the inner edge helix θ' to be larger than that of the outer edge helix θ. In other embodiments, the angles θ and θ' may have opposite signs. That is, the inner edge may progress along a downward sloping helix while the outer edge progresses along an upward sloping helix, or vice versa.

Figure 5:
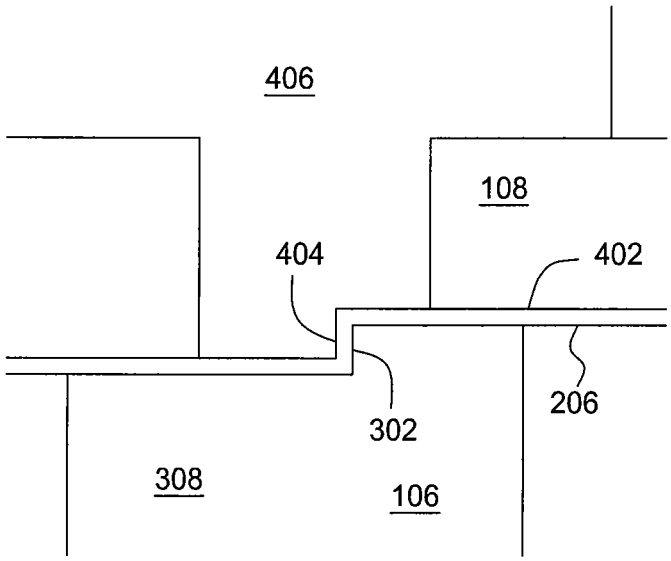
FIG. 5 is a detailed view of the collar and the compression ring of FIGS. 3A and 4A.

FIG. 5 is a detailed view showing the collar 106 and the compression ring 108 spaced closely apart to illustrate the relationship between the locking faces 206 and 214 of the collar 106 and the compression ring 108, respectively. In general, the ridges 302 and 404 will mate when the collar 106 is in a first position. When the ridges 302 and 404 are mated, the locking faces 206 and 214 of the collar 106 and the compression ring 108 are in their closest spaced relationship. If the collar 106 is rotated a short distance, the ridges 302 and 404 begin to diverge, and the locking faces 214 and 206 increase in distance from each other. This axial movement of the collar 106 and the compression ring 108 with respect to each other applies axial force to the locking ring 110 and the cylinder 104, abutting the compression ring 108 and the collar 106, respectively. The axial force urges the cylinder 104 against the fluid manifold 102 to maintain the seal between the cylinder 104 and the fluid manifold 102.

In embodiments featuring a plurality of ridges 302 or 404, the ridges will generally be symmetrically spaced around the collar 106 or the compression ring 108. All the ridges 302 of the collar 106 have substantially the same height, and all the ridges 404 of the compression ring 108 have substantially the same height, but the ridges 302 of the collar 106 need not have substantially the same height as the ridges 404 of the compression ring 108. The height, number, and spacing, of the ridges 302 and 404 will generally determine the degree of rotation and rotational force required to tighten the cylinder liner retention assembly of FIG. 1. In most embodiments, the height, number, and spacing of ridges 302 and 404 will be selected to provide a tight seal of the cylinder 104 against the fluid manifold 102 with a reasonable turning force and distance, which may be applied using a suitable tool, an example of which is discussed in more detail below in connection with FIG. 8A-8D. In most embodiments featuring a plurality of ridges 302 or 404, the number of ridges 302 of the collar 106 will be the same as the number of ridges 404 of the compression ring. In some embodiments, however, the number of ridges 302 of the collar may be an integer multiple of the number of ridges 404 of the compression ring. In other embodiments, the number of ridges 404 of the compression ring 108 may be an integer multiple of the number of ridges 302 of the collar 106.

Figure 6:
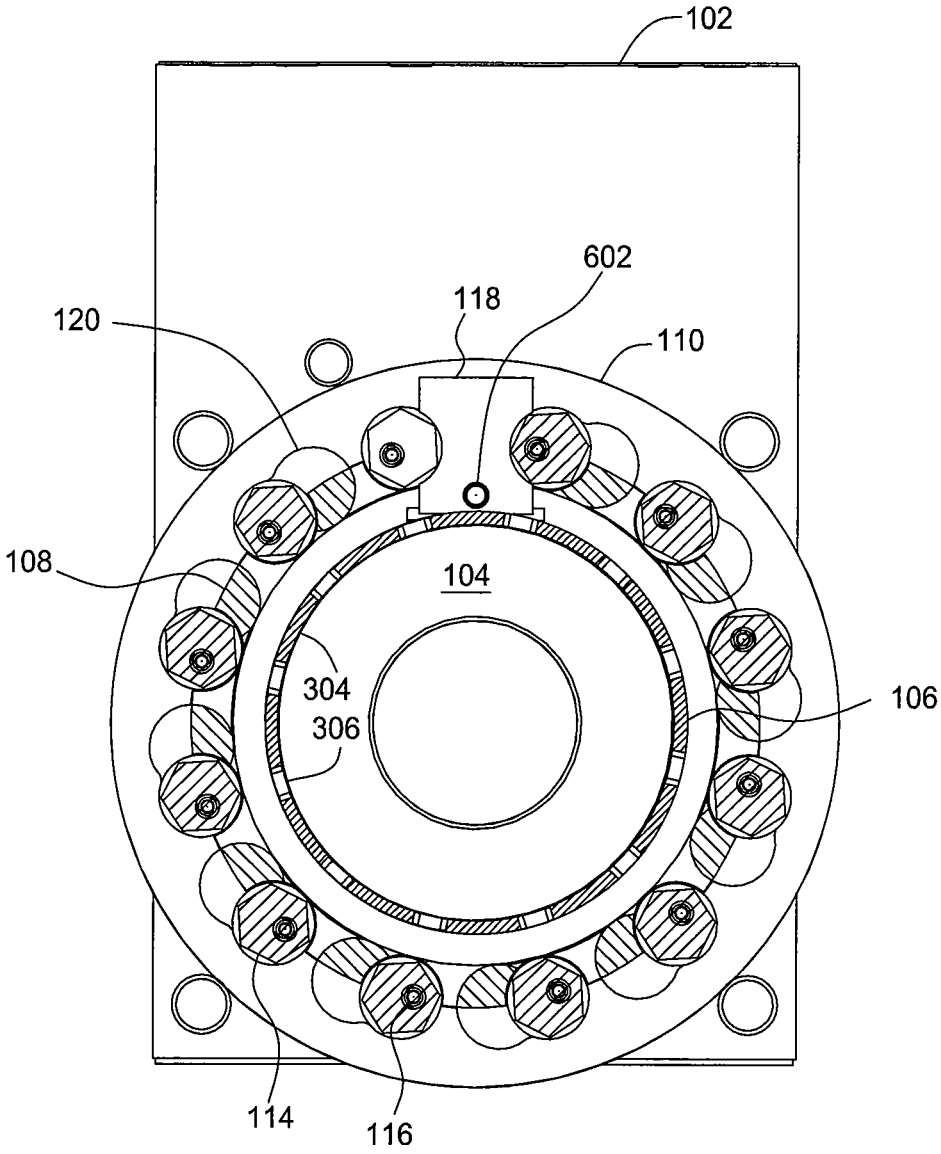
FIG. 6 is a front view of the cylinder liner retention assembly of FIG. 1 in an assembled state.

FIG. 6 is a front view of the retention assembly of FIG. 1 in an assembled state. The collar 106 is disposed about the cylinder 104, with the fluid manifold 102 shown at the rear. The compression ring 108 is visible through the openings 120 in the locking ring 110. A portion of each opening 120 is obscured from view by one of the heads 114. Whereas the portion of each opening 120 that is visible has a diameter greater than a diameter of each of the heads 114, the portion of each opening 120 obscured by one of the heads 114 has a diameter smaller than that of each of the heads 114. The openings 120 with two portions having two different diameters can be seen also in FIG. 1. The locking ring 110 is thus installed by positioning the installed heads 114 through the large portions of the openings 120 and turning the locking ring 110 to engage the heads 114 in the small portions of the openings 120. The clamp 118 is then installed between the heads 114 to prevent counter-rotation of the locking ring 110. The clamp 118 is permanently attached to the locking ring 110 after installation by applying a fastener 602, such as a screw or bolt, that penetrates the clamp 118 and lodges in the locking ring 110. As described above, the heads 114 of the fasteners 112 may be permanently attached to the fasteners 112 by applying the fasteners 116. The fingers 304 and grooves 306 of the collar 106 are accessible from the front of the assembly to facilitate rotation of the collar 106 to tighten the assembly. Any suitable tool may be used to facilitate rotating the collar 106, one example of which is discussed in more detail below in connection with FIG. 8A-8D.

In general, all components of the retention assembly described herein are made of any hardened steel suitable for the service in which the assembly is deployed. One or both variable topology surfaces may be coated with a malleable material, such as a soft metal or other non-ferrous metal, for example copper, bronze (nickel-aluminum alloy), or titanium, to promote spreading of the force applied between the surfaces of the collar and the compression ring. A thin layer of malleable material will generally suffice, such as a thickness less than about 0.01 in., for example about 0.005 in. The layer may be deposited in any convenient manner, such as by plating, for example electroplating or electroless plating, sputtering, or plasma spraying.

Figure 7:
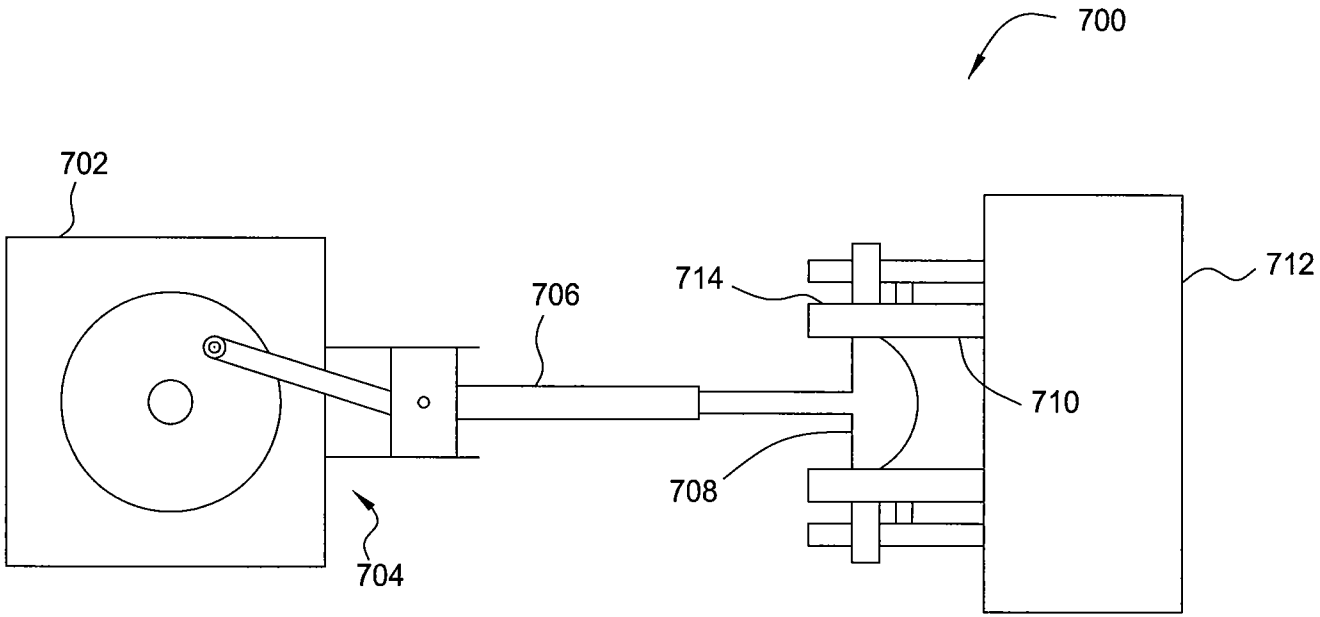
FIG. 7 is a schematic side view of a reciprocating force delivery device employing the cylinder retention assembly of FIG. 1.

FIG. 7 is a schematic side view of a reciprocating force delivery device 700 employing the retention assembly described above. The device 700 generally comprises a motor 702, a reciprocating drive 704 comprising a piston assembly 706 with a piston 708 movably disposed inside a cylinder 710 that abuts a fluid manifold 712. The cylinder 710 is urged against the fluid manifold 712 by a cylinder retention assembly 714 according to any of the embodiments described herein. The retention assembly 714 facilitates easy installation, comprising sliding a collar, a compression ring, and a locking ring over the cylinder 710 to seat against an outwardly extending stop of the cylinder (as shown in FIG. 2), installing fasteners and fastener heads (as shown in FIGS. 1 and 2), positioning a locking ring and turning to lock (as shown in FIG. 6), and rotating the collar to tighten (as described in connection with FIGS. 5 and 6).

Figure 8A:
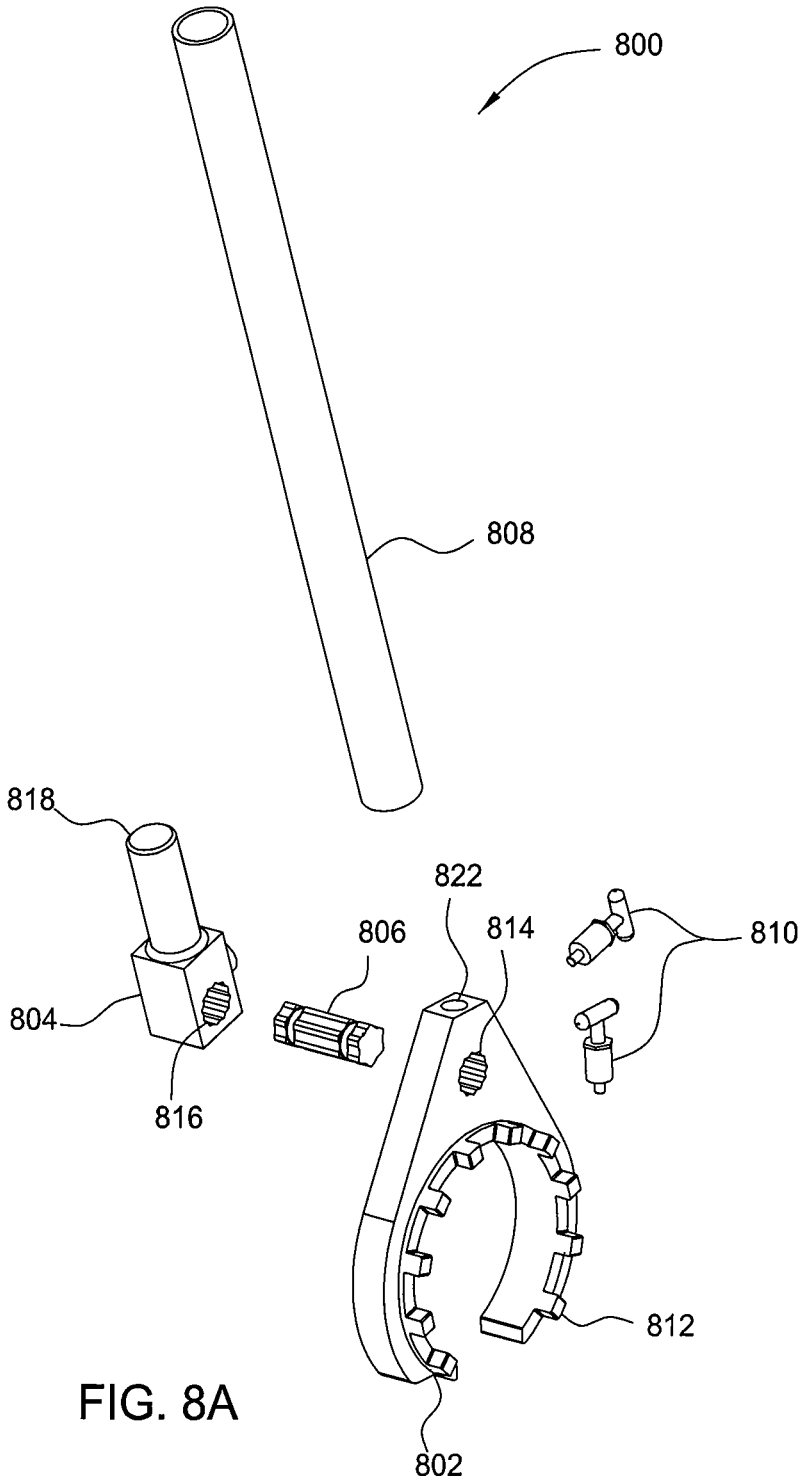
FIG. 8A is an exploded isometric view of a torque tool according to another embodiment.

FIG. 8A is an exploded isometric view of a torque tool 800 according to an embodiment. The torque tool 800 is suitable for use with the retention assembly described elsewhere herein. The torque tool 800 comprises an engagement member 802 to which a handle 804 is coupled by a torque bit 806. The torque bit 806 is inserted into openings 814 and 816 in the engagement member 802 and the handle 804, respectively. Locking pins 810 are provided to lock the torque bit 806 into the device. One locking pin 810 is inserted into an opening 822 in the engagement member 802, and another is inserted into a similar opening in the handle 804, which is visible in the view of FIG. 8C. An extender 808 may be used with the handle 818 to apply more torque. The engagement member 802 comprises fingers 812 that mate with the grooves 306 of the collar 106 (FIG. 3).

Figure 8D:
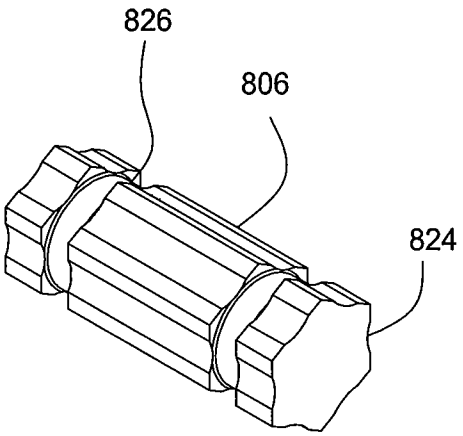
FIGS. 8B-8D are detailed views of components of the torque tool of FIG. 8A.
Figure 8C:
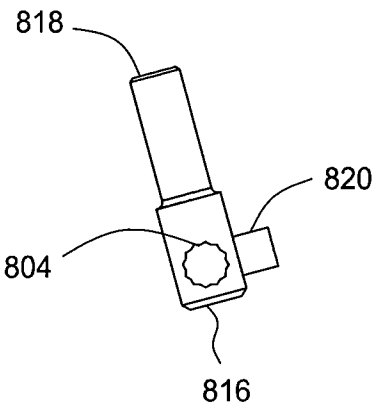
Figure 8B:
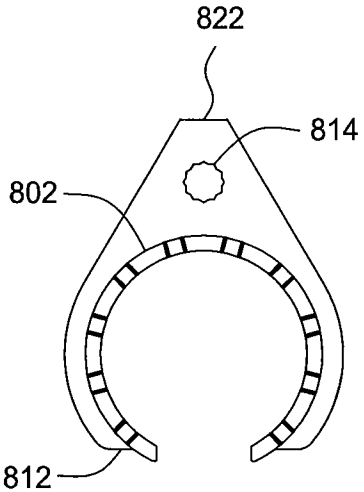

The engagement member 802 is shown in the detailed view of FIG. 8B. The engagement member mates with the collar 106 when the retention assembly is in an assembled state, as shown in FIG. 6, by fitting over the assembly such that the fingers 812 project into the grooves 306. Applying torque to the tool turns the collar 106 and tightens the retention assembly as described above. The opening 814 is formed by two hexagonal bores rotated 15° with respect to each other. This provides a large number of engagement surfaces for the torque bit 806 (FIGS. 8A and 8D) to engage.

The handle 804 is shown in the detailed view of FIG. 8C. The opening 816 for the torque bit 806 is formed in a similar manner to the opening 814 in the engagement member 802. One of the locking pins 810 is inserted into the opening 820 to lock the torque bit 806 into the opening 816.

The torque bit 806 is shown in the detailed view of FIG. 8D. The torque bit 806 may be formed from a rod with hexagonal cross-section by forming scallops 824 in the facets of the hexagonal rod and locking rings 826 at either end of the torque bit 806. The scallops 824 provide clearance for protrusions in the openings 814 and 816, and the locking rings provide a mechanism for the locking pins 810 to engage with the torque bit 806.

The configuration of the tool 800 is adjustable to allow use in confined spaces. The positional relationship of the handle 804 and the engagement member 802 may be adjusted by removing the torque bit 806, adjusting the relative orientation of the handle 804 and engagement member 802, and reinserting the torque bit 806. The torque bit 806 and openings 814 and 816 of FIGS. 8A-8D allow for adjustment in 15° increments to facilitate use of the tool in areas where the long handle of a wrench may be constrained. The torque tool 800 of FIGS. 8A-8D is also capable of applying more torque than conventional socket wrenches due to the torque bit 806 and locking pins 810. In an alternate embodiment, a suitable torque tool may be constructed with openings in the engagement member and handle formed by a square dual-bore with the two bores rotated 45°. The torque bit for such an alternative embodiment may be constructed in similar fashion to the torque bit 806 above, but starting with a rod of square cross-sectional shape.

As mentioned above, the tool 800 of FIGS. 8A-8D is an example of a tool that may be used with embodiments disclosed herein. It should be noted, however, that the tool 800, and alternative embodiments thereof, may be configured to apply torque to any object by adjusting the mating features of the engagement member 802. For example, the engagement member may be configured to mate with fasteners of many kinds, including square and hexagonal bolts.

While the foregoing is directed to embodiments of the invention, other and further embodiments of the invention may be devised without departing from the basic scope thereof.

What is claimed is:

1. A retention assembly for a reciprocating force delivery device having a cylinder abuting a fluid manifold, comprising:

a collar rotatably disposed around the cylinder;

a locking ring disposed around the cylinder and distal to the fluid manifold;

a compression ring between the locking ring and the collar; and a plurality of fasteners that fasten the locking ring to the fluid manifold.

2. The retention assembly of claim 1, wherein the collar has a flange at a first end of the collar that seats on a stop on the cylinder.

3. The retention assembly of claim 1, wherein the collar has a flange at a first end of the collar, the flange having a first face that abuts a stop on the cylinder and a second face that abuts a first surface of the compression ring, wherein a distance between the first face and the second face of the flange defines a thickness of the flange that varies from an average value by less than about 2%.

4. The retention assembly of claim 3, wherein the thickness of the flange varies from an average value by less than about 1%.

5. The retention assembly of claim 3, wherein the compression ring has a second surface, which together with the first surface defines a thickness of the compression ring that varies from an average value by less than about 2%.

6. The retention assembly of claim 4, wherein the compression ring has a second surface, which together with the first surface defines a thickness of the compression ring that varies from an average value by less than about 1%.

7. The retention assembly of claim 3, wherein the second face of the flange has one or more ridges, each of which extends a radial distance from an inner edge of the second face toward an outer edge of the second face.

8. The retention assembly of claim 7, wherein each of the one or more ridges extends from the inner edge of the second face to the outer edge of the second face.

9. The retention assembly of claim 7, wherein the first surface of the compression ring has one or more ridges, each of which extends a radial distance from an inner edge of the first surface toward an outer edge of the first surface.

10. The retention assembly of claim 9, wherein the collar rotates with respect to the compression ring and the cylinder to apply an axial force to the compression ring and the cylinder.

11. A reciprocating force delivery device, comprising:

a motor;

a reciprocating drive that couples the motor with a piston assembly comprising a piston movably disposed within a cylinder;

a fluid manifold abutting an end of the cylinder; and a retention assembly attached to the fluid manifold and disposed around the cylinder, comprising a locking ring attached to the fluid manifold by fasteners, and a rotatable collar disposed between the locking ring and a shoulder of the cylinder such that rotation of the rotatable collar applies an axial force to the cylinder and the locking ring.

12. The reciprocating force delivery device of claim 11, further comprising a compression ring between the locking ring and the rotatable collar.

13. The reciprocating force delivery device of claim 12, wherein the rotatable collar has a flange at a first end, the flange having a first face that abuts a stop on the cylinder and a second face that abuts a first surface of the compression ring, and the distance between the first face and the second face defines a thickness of the flange that varies from an average value by less than about 2%.

14. The reciprocating force delivery device of claim 13, wherein the compression ring has a second surface, which together with the first surface defines a thickness of the compression ring that varies from an average value by less than about 2%.

15. The reciprocating force delivery device of claim 13, wherein the second face of the flange has one or more ridges, each of which extends a radial distance from an inner edge of the second face toward an outer edge of the second face.

16. The reciprocating force delivery device of claim 15, wherein each of the one or more ridges extends from the inner edge of the second face to the outer edge of the second face.

17. The reciprocating force delivery device of claim 15, wherein the first surface of the compression ring has one or more ridges, each of which extends a radial distance from an inner edge of the first surface toward an outer edge of the first surface.

18. The reciprocating force delivery device of claim 17, wherein the collar rotates with respect to the compression ring and the cylinder to apply an axial force to the compression ring and the cylinder.

19. The retention assembly of claim 1, wherein heads on the fasteners protrude through openings in the locking ring shaped to engage the heads on the fasteners when the locking ring is rotated.

20. The reciprocating force delivery device of claim 11, wherein heads on the fasteners protrude through openings in the locking ring shaped to engage the heads on the fasteners when the locking ring is rotated.

21. A method of maintaining a seal between a reciprocating force delivery device comprising a piston movably disposed within a cylinder, and a fluid manifold coupled to the cylinder, comprising:

providing a rotatable element located between a stop on an external surface of the cylinder and a locking ring fastened to the fluid manifold with fasteners;

forming a variable topography interface between the rotatable element and a compression ring disposed between the rotatable element and the locking ring; and rotating the rotatable element with respect to the compression ring to apply an axial force to the cylinder and the locking ring.

22. The method of claim 21, wherein forming the variable topography interface between the rotatable element and the compression ring comprises creating protrusions and recesses on facing surfaces of the rotatable element and the compression ring such that the protrusions on one surface mate with recesses on the other.

23. The method of claim 22, wherein rotating the rotatable element juxtaposes protrusions on one of the facing surfaces with protrusions on the other facing surface to increase the distance between the locking ring and the cylinder.

* * * * *